US005431104A

United States Patent [19]

Barker

[11] Patent Number: 5,431,104

[45] Date of Patent: Jul. 11, 1995

[54] EXPLODING FOIL INITIATOR USING A THERMALLY STABLE SECONDARY EXPLOSIVE

[76] Inventor: James M. Barker, P.O. Box 42800, Houston, Tex. 77242-8044

[21] Appl. No.: 272,964

[22] Filed: Jul. 11, 1994

Related U.S. Application Data

[63] Continuation of Ser. No. 79,436, Jun. 14, 1993, abandoned.

[51] Int. Cl.[6] ..... F42B 3/10

[52] U.S. Cl. ..... 102/312; 102/313; 102/202.7; 149/105

[58] Field of Search ..... 149/105; 102/312, 313, 102/202.7

[56] References Cited

U.S. PATENT DOCUMENTS

| | | | |
|---|---|---|---|
| 3,091,177 | 5/1963 | Grebe | 102/22 |
| 4,428,292 | 1/1984 | Riggs | 102/202.7 |
| 4,602,565 | 7/1986 | MacDonald et al. | 102/202.7 |
| 4,762,067 | 8/1988 | Barker et al. | 102/313 |
| 4,861,924 | 8/1989 | Riggs | 568/931 |
| 4,944,225 | 7/1990 | Barker | 102/202.5 |
| 4,998,477 | 3/1991 | Barker | 102/275.6 |
| 5,275,106 | 1/1994 | Cutting et al. | 102/202.7 |
| 5,291,828 | 3/1994 | Nerheim et al. | 102/202 |

OTHER PUBLICATIONS

Schwarz, Alfred C.; *A New Technique for Characterizing an Explosive For Shock Initiation Sensitivity*, Dec. 1975, National Technical Information Service, U. S. Department of Commerce.

*Primary Examiner*—Peter A. Nelson

[57] ABSTRACT

An exploding foil initiator for operation with perforating gun assemblies or other equipment placed in a well borehole is set forth. This device utilizes a foil bridge adjacent to a flyer layer and a barrel having a central bore. When the foil bridge is vaporized, a disk is cut by the bore, and is directed through the bore of the barrel, traveling at a high velocity to deliver impact against a secondary explosive. The secondary explosive is formed of BRX explosive which is a pellet of explosive material of 1,3,5-trinitro-2,4,6-tripicrylbenzene. Detonation is accomplished with a high voltage, high current pulse of substantial voltage amplitude of about 1100 to not more than about 2000 volts.

9 Claims, 1 Drawing Sheet

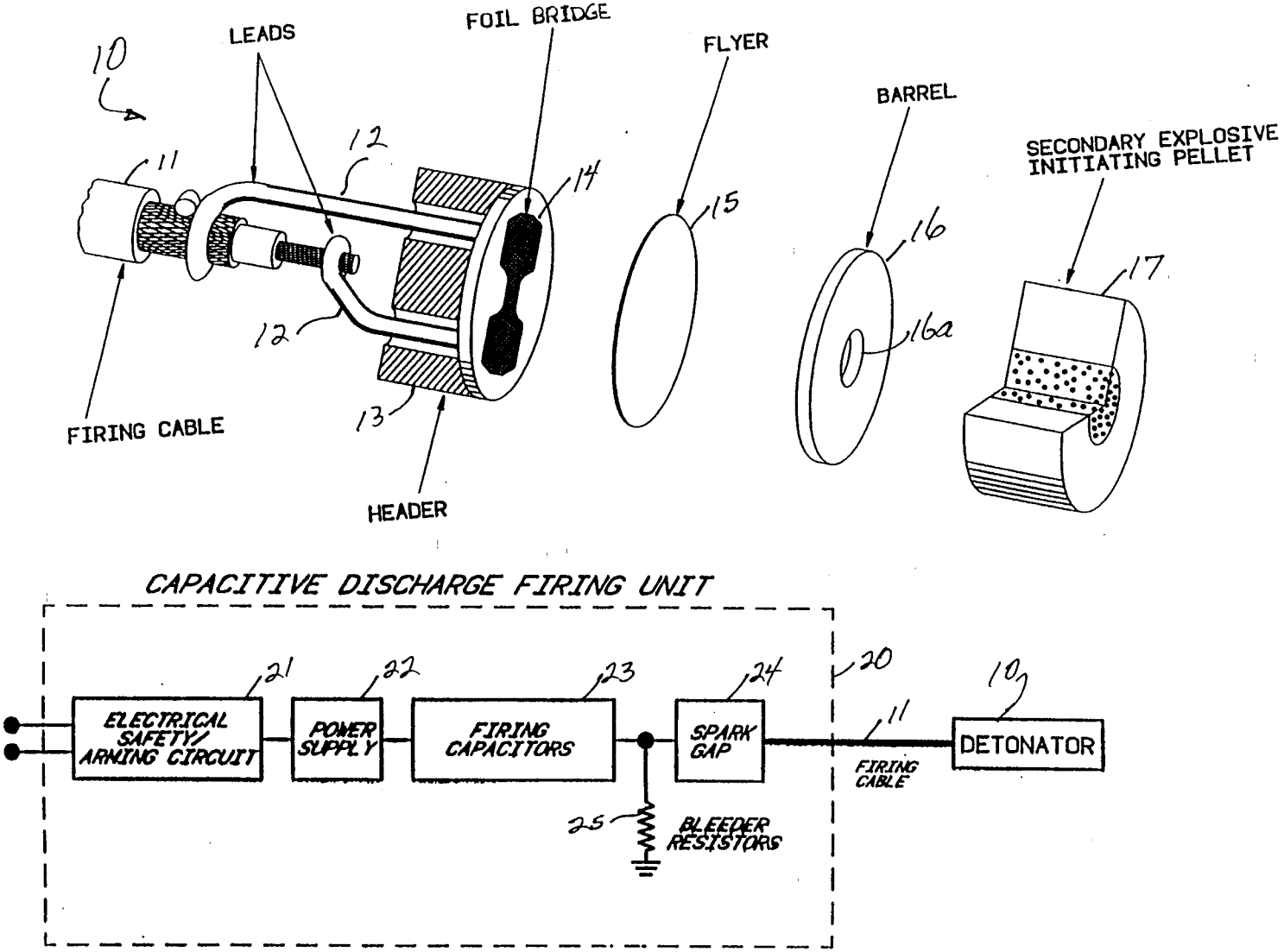
SECONDARY EXPLOSIVE INITIATING PELLET
17
BARREL
16
16a
FLYER
15
FOIL BRIDGE
14
HEADER
13
12
12
LEADS
11
10
FIRING CABLE
CAPACITIVE DISCHARGE FIRING UNIT
20
DETONATOR
19
FIRING CABLE
11
SPARK GAP
24
BLEEDER RESISTORS
25
FIRING CAPACITORS
23
POWER SUPPLY
22
ELECTRICAL SAFETY/ ARMING CIRCUIT
21

EXPLODING FOIL INITIATOR USING A THERMALLY STABLE SECONDARY EXPLOSIVE

This is a continuation of copending application Ser. No. 08/079,436 filed on Jun. 14, 1993, and now abandoned.

BACKGROUND OF THE DISCLOSURE

After an oil or gas well has been drilled to a specified depth, the next procedure typically involves placing casing in the well to some depth. The casing is typically cemented in place to prevent external leakage along the well borehole. One of the important aspects in the well completion procedure involves the use of explosives including perforating gun assemblies. These gun assemblies are used to perforate holes in the cemented casing to allow the production of downhole hydrocarbons. A typical gun assembly can range from a few feet to several hundred feet in length and typically is deployed in the well borehole supported on a tubing or wireline string. This includes one or more perforating guns, and typically hundreds of shaped explosive charges deployed along the length of the perforating gun assembly. These devices are formed of high explosives which are interconnected by a detonating cord. If prematurely detonated, they can cause severe damage to the equipment including the partially completed well. If prematurely detonated at or near the surface, they can injure and even kill surface located personnel. With a view towards safety, the use of explosive detonators is especially dangerous, even more so in the crowded confines of an offshore drilling platform. The risk is enhanced or increased by the presence of radio frequency energy as well as AC power generators. Practically every offshore drilling platform includes operative radio frequency signal generating devices and also AC power generators. In light of this hostile environment in close quarters with a number of personnel in the immediate vicinity of the perforating gun assembly when it is assembled at the well surface, it is extremely important to use detonators which are very difficult to fire or set off, and which might set off the explosive string including the detonating cord and numerous shaped charges.

The term secondary explosive, in contrast with the term primary explosive, defines an energetic material which is relatively insensitive to initiation by external stimuli, such as heat, impact friction, and static discharge. The term exploding foil initiator (EFI) describes a type of detonator that utilizes only secondary explosives. EFI's require very high power inputs (megawatts) to function and are considered extremely safe. They are well known in the explosive art.

The use of a relatively insensitive secondary explosive in an exploding foil initiator (EFI) renders such a device rather insensitive to accidental initiation. An EFI using the popular secondary explosive HNS-4 requires a high current DC pulse. The pulse can be on the order of 2500–3000 volts to reliably trigger the device. Such a device used in conjunction with a perforating gun assembly provides a thermally stable secondary explosive mechanism which renders the EFI safe for use in a perforating gun assembly, and is therefore quite safe because of its lack of sensitivity. By contrast however, this requires a larger voltage pulse, and a larger current in the pulse to initiate detonation. The generation of such a high voltage, high current pulse at great depths in a well borehole requires a downhole firing unit (consisting of safe/arm circuits, power supplies, and firing capacitors) which is deployed on the logging cable at the perforating gun assembly. This unit must be capable of operating at the typical elevated pressures and temperatures which are encountered in the well borehole and must be of sufficiently small size to pass through downhole tubulars and restrictions. The EFI of the present disclosure is a device which is ideally installed in the perforating gun assembly so that it can be lowered into a well borehole. It is an exploding foil assembly which has the inherent safety features appropriate to prevent premature detonation. In conjunction with a firing unit installed in the perforating gun assembly, the present disclosure sets forth an exploding foil initiator which actually fires at a reduced voltage which enables use of a smaller and more compact firing unit. This disclosure sets forth such an exploding foil system which has a lower voltage requirement and yet which accomplishes firing without undue sacrifice in safety.

One method of reducing the firing voltage of such a system is to utilize a secondary explosive which is more susceptible to initiation by a short duration shock pulse in comparison with those required of other secondary explosives. This highly desirable explosive material is a benzene ring explosive, sometimes known as BRX. This explosive material will initiate at a lower voltage, around 2000 volts. That is substantially less than the voltage required for the explosive HNS-4. Yet, even though it does detonate at 2000 volts, it will not initiate at levels around 1100 volts. This defines a very safe device because stray voltages at these levels are not usually present during normal oil rig operations. In addition, the thermal stability of BRX exceeds that of HNS, thus reinforcing its desirability for downhole use.

BRIEF DESCRIPTION OF THE INVENTION

All of the foregoing aspects and considerations which relate to the desirability of the present disclosure in setting forth an EFI for downhole use yields a thermally stable and generally shock insensitive device which is nevertheless properly sensitive to the intended mode of detonation and more easily and reliably detonated at reduced voltages than heretofore. The present device uses an explosive known as BRX defined here in lieu of other secondary explosives such as NONA or HNS-4. An EFI incorporating this explosive utilizes the BRX secondary explosive (benzene ring explosive as noted above) and provides a design which is given in detail for the exploding foil initiator. For a more complete and thorough understanding of the present disclosure, the detonator described below is a detonating device which, when viewed in conjunction with the drawings to be discussed, provides the new and useful structure for perforating gun assemblies.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a schematic diagram showing construction of an exploding foil initiator in accordance with the teachings of the present disclosure further having a firing cable connected to a foil bridge spaced from a secondary explosive pellet operating in conjunction with a flyer disk and barrel having a perforation therein to direct the flyer disk into contact with the secondary explosive; and FIG. 2 is a schematic block diagram of the exploding foil initiator of the present system along with a capacitive discharge firing system for operation.

DETAILED DESCRIPTION OF THE PREFERRED EMBODIMENT

Attention is first directed to FIG. 1 of the drawings where the EFI in accordance with the present disclosure is identified generally by the numeral 10. This disclosure sets forth an EFI having a lower voltage requirement for initiation in contrast with those available otherwise and especially one for use in the environment encountered in a deep well borehole, yet which provides an EFI with the essential safety features. Thus, the EFI of FIG. 1 is a relatively high voltage, high current pulse operated detonator mechanism which is connected at the end of the firing cable 11. An electrical pulse is conducted through the leads of the firing cable which terminate in the two individual leads 12 which pass through appropriate ports or holes formed in a header 13. The header in turn has an exposed planar face which supports a foil bridge 14. On the application of a substantial current pulse across the foil bridge flowing at a peak current of several thousand amps, the narrow neck in the foil bridge 14 forces the current flow between the two leads to flow through the narrow neck in a region where the current density becomes exceedingly high, thereby causing the foil to vaporize instantly, and forming a rapidly expanding vapor cloud. The vapor from the foil raises the pressure on the back face of a flyer disk layer 15 which is positioned immediately adjacent to the foil bridge 14. In turn, that is placed on the nether face of a rigid barrel 16 provided with a centrally formed bore **16*a*. The barrel can be made of several types of materials, but the preferred form is a hard plastic or ceramic. This forms a flying disk by virtue of the shape of the bore 16*a*. This defines a shape which cuts the flyer material, thereby forming a circular disk or chip of the flyer material. One suitable flyer material is the sheet plastic material known as Kapton (Dupont trademark). This sheet of material is positioned in facial contact with the barrel at all locations except at the bore, and cuts a portion from the sheet material which is trimmed around the periphery, cut in the manner of a cookie cutter, which flyer is accelerated or propelled along the bore 16*a* through that passage so that it impacts against the secondary explosive initiating pellet 17**.

The pellet 17 of the present disclosure is a pressed pellet of granular BRX explosive material. More particularly, it is the material described in one form in U.S. Pat. No. 4,861,924 which is assigned to the assignee of the present invention. As set forth in that patent disclosure, the chemical name of the material is 1,3,5-trinitro-2,4,6-tripicrylbenzene. That is the secondary explosive which cooperates with other components to provide perforation gun operation.

Attention is now directed to FIG. 2 of the drawings. In FIG. 2 of the drawings, the numeral 20 identifies a capacitive discharge firing system which supplies the high voltage, high current pulse. More particularly, an electrical safety and arming circuit 21 is incorporated in the capacitive discharge firing unit 20. It is activated from the surface by a signal provided over a set of conductors extending along the well borehole in a well logging cable. The circuit 21 prevents operation of the power supply assembly until the appropriate arming signal is provided to initiate the power supply. The system also includes a DC power supply 22 which is provided with operative current from a DC source. One such device can be a cascaded bridge type system which converts a relatively low voltage provided on the logging cable to an elevated voltage, preferably in the vicinity of 2000 volts DC or greater. Preferably, this DC voltage is stored on one or more parallel firing capacitors 23. FIG. 2 further shows a spark gap 24 which operates in conjunction with a bleed resistor 25 to ground. An alternate form of circuit utilizes an avalanche diode provided with the appropriate bias voltage circuit. These components cooperate with the stored charge on the firing capacitor 23 so that the desired peak pulse can be obtained when the equipment is operated. The output of the spark gap 24 is provided to the firing cable 11 which connects with the detonator which incorporates the EFI 10 of the present disclosure. The total capacitance must be sized to enable provision of a substantial current on the short firing cable as will be discussed. The capacitors must be sized to fit within an outer housing which is capable of passing through typical production tubing strings (the housing typically has an outside diameter of about 1.69 inches or less). This relatively small-sized dimension requires the capacitor to be relatively long in order to reliably initiate EFI's using HNS-4. The capacitor geometry (which is tied to voltage and capacitance rating) can be reduced with EFI's using BRX. Thus, the BRX secondary explosive in the exploding foil initiator of the present disclosure enables the system to respond more readily to a very safe high voltage pulse which nevertheless does not reach and does not require the extremely high voltage levels known heretofore. This enables reliable triggering at a voltage pulse at about 2000 volts in comparison with 2500 and 3000 volts achieved heretofore. The initiator of the present disclosure therefore is easier to detonate by requiring a reduced operating voltage in contrast with initiators constructed of HNS-4 secondary explosive.

Laboratory tests have shown that the BRX constructed initiator of the present disclosure is more thermally stable than HNS-4 initiators and has the above mentioned lowered voltage initiation requirement. In terms of safety, pulse voltages of up to 1100 volts will not initiate the BRX secondary explosive. Thus, voltages of the sort which might otherwise trigger conventional blasting caps do not in fact trigger this construction of initiator. In this context, the BRX based initiator is safer to use in perforating gun assemblies.

While the foregoing has been directed to the preferred embodiment, there are variations and changes in the embodiments of the present disclosure which will be readily apparent to those of ordinary skill in the art. The aim and thrust of the appended claims is to cover variations that fall within the true spirit and scope of the disclosed invention, and the claims thus set forth the present invention.

What is claimed is:

1. A thermally stable exploding foil initiator which comprises:

(a) circuit means for supplying a high voltage, high current pulse in excess of about 1100 volts to a metallic foil bridge connected thereto;

(b) a barrel cooperatively arranged with a flyer layer and having a bore therethrough for directing a portion of said flyer layer for passage through said bore and further directing said flyer along said bore; and (c) a secondary explosive BRX initiator pellet disposed adjacent to said barrel and positioned so that the said propelled flyer is directed thereagainst by said barrel for initiation of said secondary explosive BRX pellet.

2. The apparatus of claim 1 wherein said secondary explosive is 1,3,5-trinitro-2,4,6-tripicrylbenzene.

3. The apparatus of claim 2 wherein said circuit means forms a high voltage, high current pulse of about 2000 volts.

4. The apparatus of claim 1 wherein said foil bridge is positioned in a planar layer adjacent to said flyer layer and is sandwiched between a header and said barrel to confine said foil bridge and flyer therebetween so that said flyer layer forms said flyer for impact against said initiator pellet.

5. The apparatus of claim 1 wherein said pellet is sized to abut said barrel, and said barrel and said flyer layer are circular disks.

6. The apparatus of claim 5 wherein said pellet is axially located at the end of the bore in said barrel.

7. A method of initiating a detonator for use in a well borehole which comprises the steps of:

(a) lowering a firing unit into a well borehole connected by a firing cable to a detonator;

(b) forming a high voltage, high current pulse from said firing unit which pulse is at least about 1100 volts up to about 2000 volts and which has substantial current, the current being sufficient vaporize a foil bridge connected to said supply;

(c) vaporizing the foil bridge to cause formation of a flyer disk; and (d) directing said flyer disk along a pathway to impact against a secondary explosive BRX pellet responsive to said flyer disk for detonation.

8. The method of claim 7 including the step of positioning the BRX pellet at the end of a barrel with passage therein so that said flyer disk initiates an explosion.

9. The method of claim 8 including the step of firing the flyer in the barrel passage, and positioning the barrel so that the pellet is detonated as a result of the current flow through said foil bridge.

* * * * *